United States Patent [19]

Humphrey

[11] Patent Number: 4,686,516

[45] Date of Patent: Aug. 11, 1987

[54] METHOD, SYSTEM AND APPARATUS FOR USE IN ARTICLE SURVEILLANCE

[75] Inventor: Floyd B. Humphrey, Bradfordwoods, Pa.

[73] Assignee: Sensormatic Electronics Corporation, Deerfield Beach, Fla.

[21] Appl. No.: 761,611

[22] Filed: Aug. 1, 1985

Related U.S. Application Data

[63] Continuation-in-part of Ser. No. 675,005, Nov. 26, 1984.

[51] Int. Cl.[4] ..... G08B 13/26

[52] U.S. Cl. ..... 340/572; 340/551

[58] Field of Search ..... 340/572, 551

[56] References Cited

U.S. PATENT DOCUMENTS 4,484,184 11/1984 Gregor et al. ..... 340/572

OTHER PUBLICATIONS

Jaffe, Erwin, *The Science of Physics in Lithography,* Graphic Arts Technical Foundation, Inc., New York, 1964, p. 64.

Anthony, Wm. A. et al., Elementary Textbook of Physics, John Wiley & Sons, New York, 1897, p. 281.

Knowlton, *Physics for College Students,* McGraw-Hill, New York, 1928, pp. 561-562.

*Primary Examiner*—Glen R. Swann, III

*Attorney, Agent, or Firm*—Robin Blecker & Daley

[57] ABSTRACT

An electronic surveillance system marker comprises an active component responsive to incident magnetic energy for causing an associated article surveillance system to render an output alarm and deactivatable, through change in the molecular organization of the active component, without requirement for disruption of the unitary character of the component or change in its chemical composition. The marker component is selected to be of molecularly unorganized, e.g., amorphous, matter and the deactivation step involves molecularly organizing such matter, e.g., by rendering crystalline at least a portion of the component. The amorphous matter is preferably selected to be a metal composition. The deactivation step is desirably practiced by maintaining such portion of the marker component at a temperature above the crystallization temperature of the component and thereby to crystallize a coercive force in the portion different from the coercive force in the remainder of the component. Alternatively, the marker component is selected to have retained stress which is mechanically constrained therein, the deactivation step involving the relieving of such retained mechanical stress.

21 Claims, 9 Drawing Figures

FIG. 1
(PRIOR ART)
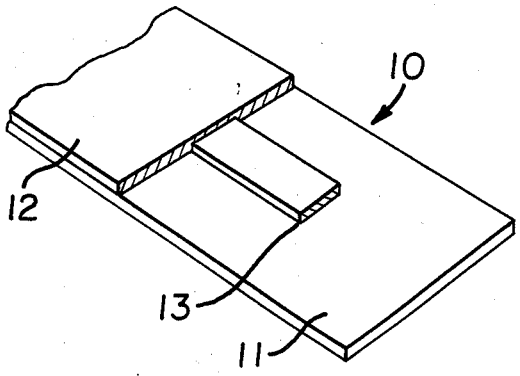
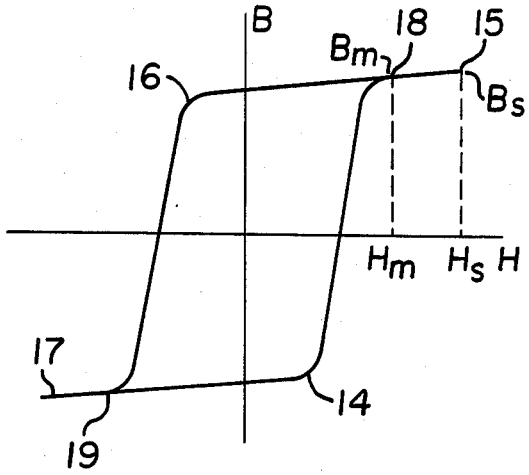
FIG. 2
FIG. 3
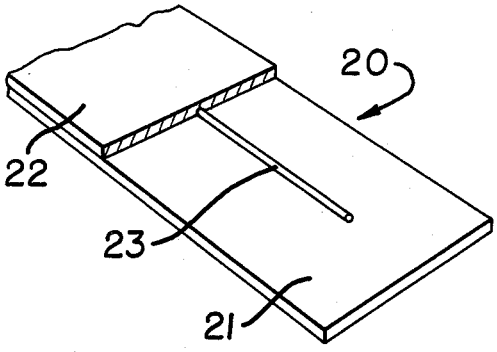
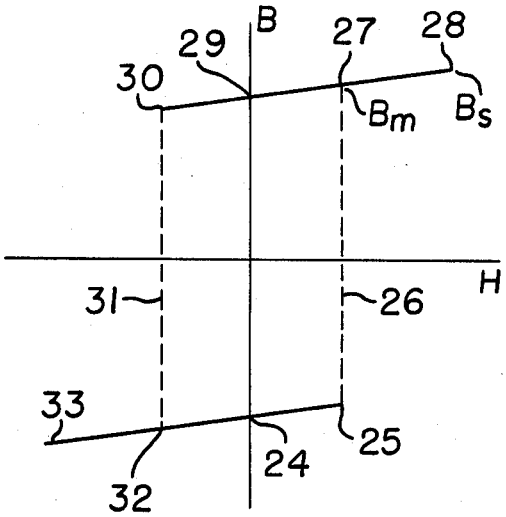
FIG. 4
FIG. 5
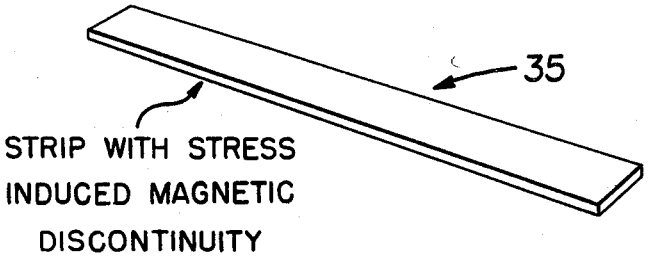

METHOD, SYSTEM AND APPARATUS FOR USE IN ARTICLE SURVEILLANCE

CROSS-REFERENCE TO RELATED APPLICATION

This application is a continuation-in-part of parent application Ser. No. 675,005, filed on Nov. 26, 1984, of applicant herein, entitled "An Article Surveillance Magnetic Marker Having an Hysteresis Loop With Large Barkhausen Discontinuities".

FIELD OF THE INVENTION

The present invention relates broadly to article surveillance and more particularly to article surveillance systems generally referred to as of the magnetic type and to methods and apparatus therefor.

BACKGROUND AND SUMMARY OF THE INVENTION

Common to prior art magnetic type article surveillance systems is the detection of perturbations induced in an incident magnetic field by an article marker in the course of reversal of magnetic polarity of the field. Typically, such prior art systems include a magnetic field generator, operative to establish an alternating magnetic field in an area of interest, i.e., a surveillance control zone, and a receiver operative to detect perturbations in the magnetic field which may be induced, specifically those of such markers.

When the marker magnetic material is driven around its hysteresis loop, from one polarity to the opposite, as occurs upon its exposure to the alternating magnetic field, a signal pulse is produced by the receiver. The shape of this pulse is a function of the time it takes to reverse polarity, i.e., proceed from one saturation point to the other, or from a residual induction point to the reverse saturation point. This time element, in prior art systems, is a function of the time rate of change of the incident field between levels sufficient to effect such polarity reversal.

The primary prior art effort has been directed to the finding of marker magnetic materials with higher and higher permeability and lower and lower coercivity, thereby to give rise to increased slope of the transition from one polarity to the other, otherwise stated, lesser time for the transition. Since the generation of higher order harmonics of sufficient amplitude to be readily detectable attends such increased slope, enchanced discrimination as against perturbations induced in the magnetic field by commonplace objects in the surveillance control zone is thereby attainable. With the same purpose in view, prior art systems have looked to operation at relatively high frequencies and/or with strong incident fields, and the latter is generally sought by establishing narrow surveillance control zones to limit the distance from marker to antenna.

In applicant's view, these efforts have not yielded magnetic markers which produce article tags which, in response to a surveillance field interrogation, provide a signal sufficiently unique that the marker is free from being mimicked by at least some commonplace article. For example, certains samples of nickel plating have been observed to produce signals, responsively to such magnetic fields, that cause false alarms in systems intended to selectively respond to markers containing Permalloy as their magnetic matter.

In the above-referenced related patent application of applicant, incorporated herein by this reference thereto, applicant reports the inclusion, in magnetic tag markers, of a magnetic material exhibiting a reversal of magnetic polarity that occurs in a regenerative fashion, such as with a large Barkhausen discontinuity in its hysteresis loop.

In a specific embodiment, the marker of the referenced related application comprises a body of magnetic material having a magnetic hysteresis loop with a large Barkhausen discontinuity such that exposure of the body to an external magnetic field, whose field strength in the direction opposing the instantaneous magnetic polarization of the body exceeds a predetermined threshold value, results in a regenerative reversal of the magnetic polarization. Quite high harmonics of readily detectable amplitude are provided by the marker, as shown and discussed in the related application.

The related application notes, at page 18 thereof, that amorphous metal wire, obtained directly from the rapid quench of molten metal, evidences the hysteresis loop desired and above discussed. The referenced text notes further that the annealing of such wire gives rise to the loss in such metal wire of its magnetic discontinuities.

In one prior art magnetic type system, deactivation of a magnetic marker is effected by the inclusion in a marker of first and second separate and distinct components of diverse magnetic material, the first serving to generate the detectable signal, and the second serving, upon the occurrence of certain marker deactivating events, to mask and render inoperative the first component. Such masking takes place at a deactivation station and is effected by subjecting the composite marker to a magnetic field of such strength as to activate the second component.

Typically, the marker is subject to a magnetic field adapted to provide output indication of an alarm condition upon presence of the marker in the surveillance zone on the basis of magnetic polarity reversal of the first marker component. On the other hand, upon the presence of the article with marker in an authorized checkout area preceding the surveillance zone, one can deactivate the marker by disposing the same in a magnetic field of character activating the second component that in turn changes the magnetic response of the first marker component.

Another prior approach to makrer deactivation involves the formation, in a resonant frequency marker printed circuit, of a fusible link, i.e., a portion of lessened cross-section than the remaining marker printed circuitry, and the disrupting of the link by exposing the marker to increased field energy sufficient to disrupt the integrity of the link. Whereas the marker was of reasonant frequency for alarm activation prior to the link disruption, it becomes otherwise upon that event, and passes freely through the surveillance control zone.

The deactivation schemes of the referenced prior art have evident disadvantage, the former in its requirement for plural separate components, respectively for activation and deactivation of the marker, and the latter in its requirement for fusible link formation in the marker printed circuit.

The present invention has as its primary object the provision of improved system, method and apparatus for the detection of unauthorized marker presence in a surveillance control zone and deactivation thereof at locations preceding entry into such control zone.

A more particular object of the invention is to provide for improved deactivation method and apparatus for magnetic markers in article surveillance systems.

In attaining the foregoing and other objects, the invention provides, in its product aspect, an electronic surveillance system marker which may comprise a unitary active component responsive to incident magnetic energy for causing an associated article surveillance system to render an output alarm, the marker being adapted to be deactivated through change in the molecular organization of the active component, without requiring disruption of the component or change in its chemical composition.

In its method aspect, the invention provides for deactivating an article surveillance marker such as of type having an active component responsive to incident magnetic energy for causing an associated article surveillance system to render an output alarm, the method including a step of modifying the molecular organization of the active component.

In a further aspect, the invention provides an electronic article surveillance system operative with an article marker such as of type comprising a component responsive to incident magnetic energy for causing an associated article surveillance system to render an output alarm, the marker being adapted to be deactivated through change in the molecular organization of its active component, such system comprising transmitting means for establishing an alternating magnetic field in a control zone of interest, receiving means for detection in said control zone of the presence of such marker if same is not deactivated, and means for deactivating such marker through such molecular organizational change.

Turning more particularly to the preferred products, methods and systems of the invention, the marker active component is selected to be of molecularly unorganized, e.g., amorphous matter, provided such as by metal wire obtained directly from the rapid quench of molten metal and having dimensions below discussed. In one product aspect, the marker is used in such unannealed state as a surveillance device. The deactivation step involvles molecularly organizing such matter, e.g., by rendering crystalline at least a portion of the component. Such deactivation step is desirably practiced by maintaining such portion of the marker component at a temperature above the crystallization temperature of the component and thereby to crystallize a coercive force in that portion different from its previous coercive force.

In a preferred embodiment, the marker deactivating means of systems of the invention modifies the molecular organization of the marker component by including an electric current supply for selective electrical connection to at least a portion of the marker component and providing such current level therein as to maintain the portion of the marker component at a temperature above the crystallization temperature of the component, thereby to crystallize such coercive force in the portion different from its previous coercive force. Radiant energy may also be employed in this deactivating practice.

Alternatively, the marker active component has stress mechanically induced therein, as by annealing wire in twisted state and constraining same in untwisted form following cooling. Stress-relieving deactivation here involves the relieving of such retained mechanical stress, as by releasing the constraint on the active component. In this instance, the deactivating means may impart mechanical force or radiant energy to the marker component.

The foregoing and other objects and features of the invention will be further understood from the following detailed discussion of preferred embodiments and practices thereof and from the drawings wherein like reference numerals identify like parts throughout.

DESCRIPTION OF THE DRAWINGS

FIG. 1 is a perspective view with portions broken away of a typical prior art magnetic marker.

FIG. 2 is a typical hysteresis curve illustrative of the magnetic characteristics of the marker of FIG. 1.

FIG. 3 is a view similar to FIG. 1, but showing a marker for deactivation in accordance with the present invention.

FIG. 4 is a hysteresis curve illustrative of the magnetic characteristic of the marker of FIG. 3.

FIG. 5 is a perspective view of a ribbon of magnetic material that has been specially processed to produce at least one Barkhausen discontinuity in its hysteresis loop and which represents another product embodiment for deactivation in accordance with the present invention.

DETAILED DESCRIPTION OF PREFERRED EMBODIMENTS AND PRACTICES

Figure 6:
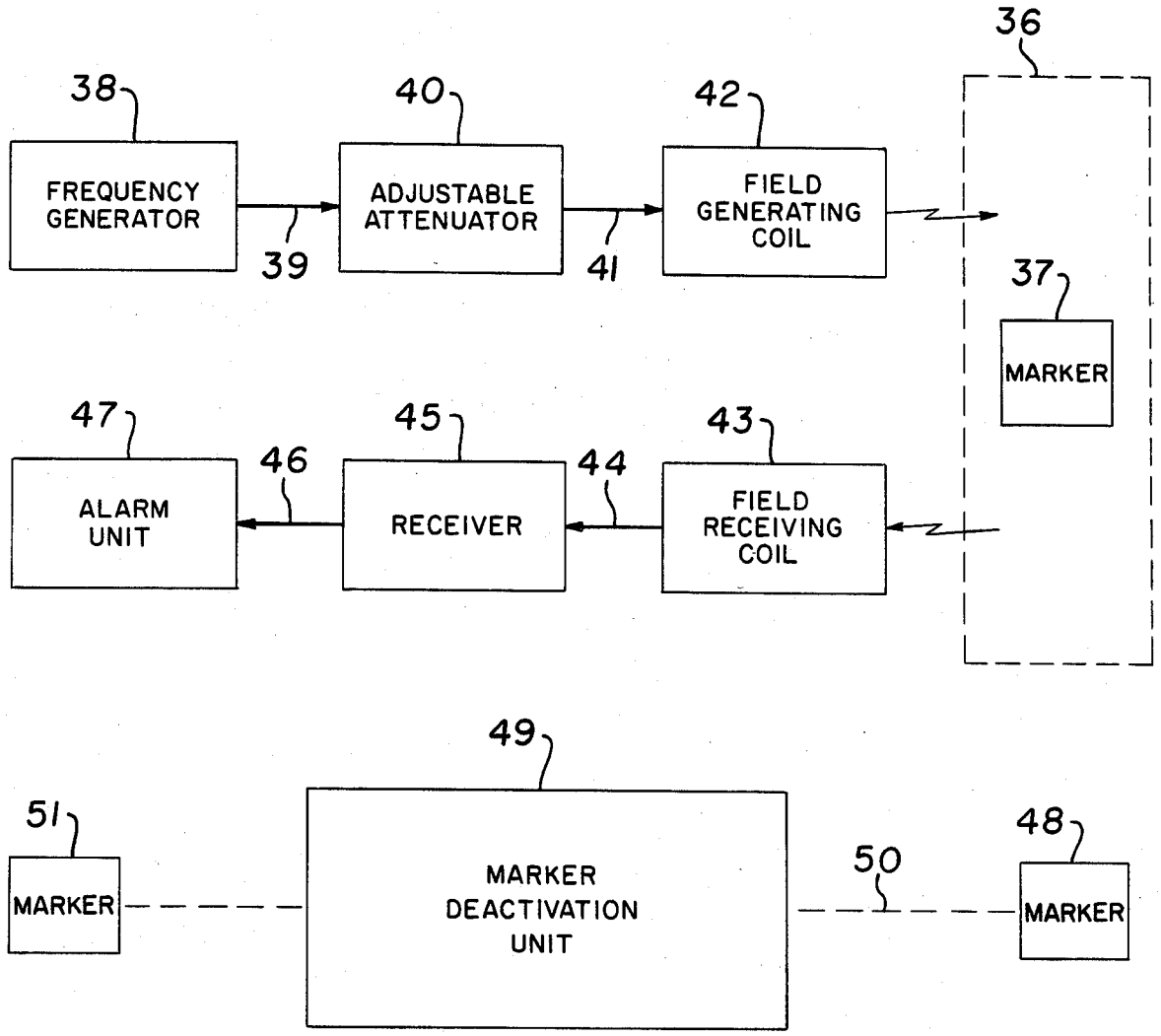
FIG. 6 is a block diagram of a typical electronic article surveillance system in accordance with the invention.

Referring now to FIG. 1, a typical prior art marker designated generally by the reference numeral 10, is shown as consisting of a substrate 11 and an overlayer 12 between which is sandwiched and concealed a length of ribbon 13 of high permeability magnetic material. The undersurface of substrate 11 can be coated with a suitable pressure sensitive adhesive for securing the marker to an article to be maintained under surveillance. Alternatively, any other known arrangement can be employed to secure the marker to the article. By way of example, ribbon 13 may be formed from 4–79 Molybdenum Permalloy 0.100 inches wide, 0.001 inches thick, and 3.0 inches long. Material coercivity, $H_c$, may be 0.05 oersteds, and permeability at one hundred hertz may be from 45,000 to 55,000.

The hysteresis loop or curve of ribbon 13 is shown in rather general terms in FIG. 2. No attempt has been made to draw the loop to any type of scale or in scale proportions for such curve would appear very tall along the B axis and very narrow along the H axis. What is significant is that the curve between the knee at 14 and positive saturation at 15, as well as from the knee 16 down to the negative saturation point at 17, has a finite slope less than infinite. In order to reverse the magnetic polarity of ribbon 13, it is necessary to subject it to an external field of at least Hm to bring the material to at least its maximum induction point 18. The speed with which this can be accomplished is a direct function of the rate of change of the incident magnetic field, and the rate of change is proportional to both the frequency and the peak amplitude of such incident field.

Another composition for the prior art marker under discussion is "Metglas" ribbon, 0.070 inches wide and 3.0 inches long, particularly "Metglas" strip/2826MB2, having a maximum permeability of 180,000, a coercivity of 0.035 oersteds, and a saturation magnetization of 9,000 Gauss.

Referring to FIG. 3, there is shown a marker 20 in accordance with the invention and having substrate 21 and overlayer 22 that can be the same as the components 11 and 12 above discussed in FIG. 1, and can be attached to an article in similar fashion. However, instead of ribbon 13, the active element in the embodiment of FIG. 3 is a length of unannealed amorphous metal wire 23. By way of example, marker 20 may be approxiamtely 7.6 cm. (three inches) in length, with a diameter of 0.125 mm., and its composition essentially satisfying the formula $Fe_{81}Si_4B_{14}C_1$, where the percentages are in atomic percent. These parameters should be considered only as representing one example for purposes of explanation since, as will appear from the ensuing discussion, the diameter can range between 0.09 and 0.15 mm. while the length can range between about 2.5 and 10 cm. for use as a surveillance marker. The demagnetizing factor for the length of wire 23, preferably does not exceed 0.000125. At present, however, the dimensions of the above sample are preferred for the wire 23.

The particular wire used for the element 23 is identified by a discontinuous hysteresis characteristic, preferably by a large Barkhausen discontinuity, such that when the magnitude of an incident field of appropriate direction relative to the magnetic polarity of the wire exceeds a low threshold value, in this case substantially less than 1.0 oersted, the magnetic polarity of the wire will reverse regeneratively, independent of any further increase in the incident field, up to its maximum induction point. The threshold for the above sample is actually less than 0.6 oersted.

The nature of the hysteresis loop is shown in FIG. 4. Again, the scale and proportions in FIG. 4 are grossly distorted from reality for the sake of convenience in explanation. Thus, the magnetizing field from the negative residual induction point 24 to the threshold point 25 is less than 1.0 oersted. Once the magnetizing field exceeds the threshold value for the sample, there occurs an abrupt regenerative reversal of the polarity, represented by the broken line segment 26 of the hysteresis loop, until the maximum induction point 27 is reached. If the magnetizing field continues to increase above the threshold point, the flux density will increase toward the positive saturation point 28. Otherwise, the element 23 will head toward its positive residual induction point 29 as the magnitude of the magnetizing field approaches zero, and will remain there until the magnetizing field departs from zero. If the magnetizing field now increases in the negative direction, the flux density will follow the stable portion of the loop to the negative threshold point 30 from which it shifts regeneratively and substantially instantaneously along the broken line segment 31 to the negative maximum induction point 32 and then to a point between saturation at 33 and threshold 25 as a function of the magnetizing field.

Change in the magnetic polarity of wire 23 between either points 25 and 27 or 30 and 32 occurs independently of the rate of change of the magnetizing field. All that is required for such change is that the magnetizing field exceed the threshold level of the particular wire element 23.

The above-mentioned sample of wire 23 was 7.6 cm. long. It has been found that varying the length over the mentioned range will influence the hysteresis loop by changing the slope of the portions 28–30 and 33–25, shown in solid lines. As the wire is made shorter, the aforementioned slope will increase, while as the wire is made longer, the slope in question will decrease. Changing the aforesaid slope will alter the sharpness of a receiver output pulse. Generally, it is the sensitivty and selectivity of the surveillance system in which the marker is to operate that determines what pulse wave shapes can be tolerated, and, therefore, the wire length can be shortened subject to the constraints of the detection system. That is, wire 23 must be long enough to produce a pulse of sufficient amplitude that it can be detected by the detecting system.

The material of wire 23 may be used to produce a ribbon of amorphous metal such as is shown in FIG. 5. The ribbon designated 35 in FIG. 5, can be produced by any known method for rapidly quenching molten metal to avoid crystallization. Starting with a ribbon about 2 mm. wide and about 0.025 mm. thick and between 3.0 and 10.0 cm. long, it should be twisted up to four turns per ten centimeters and annealed while so twisted, the annealing being performed at about 380 degrees Centigrade for about twenty-five minutes, i.e., at a temperature less than the crystallization temperature. When cool, the ribbon should be untwisted and laminated in mechanically constrained manner within substrate and overlayer in a flat condition similar to that shown in FIG. 1. The flattened ribbon will have locked in stresses providing a helical easy axis of magnetization and giving rise to the subject discontinuities. In other words, the ribbon or strip should have stress induced magnetic discontinuity when restrained in flattened condition.

The dependency of prior art markers on time rate of change of the incident field has led prior workers in the article surveillance field toward the use of higher and higher frequencies. However, because of the unique qualities of markers according with the invention, there is an advantage to be obtained from resorting to lower rather higher excitation frequencies. This follows from the fact that since the subject markers are relatively insensitive to the rate of change of the incident field, the suject markers respond well to very low frequency excitation. However, the low frequency, coupled with the same low field strengths as used heretofore, gives rise to smaller rather than larger rates of change of field, and this causes responses from Permalloy or other similar magnetic marker materials to become less rather more readily detectable. In this connection, it has been found that the wire marker described above with reference to FIG. 3 will produce a signal pulse of less than four hundred microseconds duration when excited by a 1.2 oersted field at twenty hertz. Consequently, the wire of the invention is easily detected while prior art markers are essentially invisible to the same interrogation field.

Amorphous metal has been known for use in surveillance markers. However, to the extent that information is available, it has been uniform practice by the manufacturers of surveillance marker material to subject the metal to a final, stress-relieving, annealing step to improve the mechanical parameters of the product. Such stress-relieving annealing would eliminate any large Barkhausen discontinuities that might have existed in the hysteresis loop of the element and lose herein desired magnetic characteristics, if it were of type discussed herein, e.g., amorphous metal wire obtained directly from the rapid quench of molten metal and of desired dimensions. In accordance with the invention, such wire or the annealed mechanically-stressed ribbon of FIG. 5 is used, without having its stress relieved, as surveillance tag material and thereafter is deactivated by relieving such stress.

In the course of deactivation of an amorphous material marker in accordance with the invention, the unitary character of its active component, wire 23 or ribbon 35, can be maintained and the chemical composition of the component persists unchanged. There occurs, however, a change in the molecular organization of the entire active component or a portion thereof. Thus, the entire marker active component or the portion thereof subjected to temperature elevation through current flow becomes molecularly ordered, i. e., is rendered crystalline. The remainder of the component remains molecularly unorganized, i. e., amorphous. The magnetic perfomance character of the marker is accordingly modified from that existing prior to deactivation, in effect, being transformed from a single active component into two active subcomponents separated from one another by the crystallized portion. The practice preferably is by use of a fast pulse of current which flash anneals, locally crystallizing a high coercive force band across the active component in contrast to the low coercive force prevailing in the remnant amorphous regions of the active component. As noted above, the entirety of the active component may be crystallized, in which case the coercive force prevailing throughout the component differs from its previous coercive force.

Deactivation in the case of the FIG. 5 type device can be achieved by annealing above the crystallization temperature of its material, or by mechanical input thereto directly or indirectly. In the latter instance, shrinkable jacketing for the material may be heated to impart stress-relieving force to the marker material.

While amorphous metal is presently preferred in practice of the invention, the invention contemplates use of any material with which the mentioned performance parameters can be obtained.

Satisfactory results have been obtained with amorphous wire markers having the following compositions:

(a) $Fe_{81}Si_4B_{14}C_1$;

(b) $Fe_{81}Si_4B_{15}$; and (c) $Fe_{77.5}Si_{7.5}B_{15}$

However, it is believed that a wide range of such materials can be used, all falling within the general formula: $Fe_{85-x}Si_xB_{15-y}C_y$, where the percentages are in atomic percent, x ranging from about three to ten and y ranging from about zero to two.

The system of the invention is shown in block diagram in FIG. 6. A control or surveillance zone, e.g., an exit area of a store, in indicated by broken lines at 36 and an article marker 37 of the above-discussed types is shown in control zone 36. The transmitter portion of the system includes frequency generator 38, the output of which is applied over line 39 to adjustable attenuator 40. the attenuator output, namely a desired level of the output of frequency generator 38, is applied over line 41 to field generating coil 42, which accordingly establishes an alternating magnetic field in control zone 36.

The receiving portion of the system of FIG. 6 includes field receiving coil 43, the output of which is applied over line 44 to receiver 45. When the receiver detects harmonic content in signals received from coil 43 in a prescribed range, the receiver furnishes a triggering signal over line 46 to alarm unit 47.

Marker 48 is shown at a location outside of control zone 36 and accordingly not subject to the field established in zone 36. An authorized checkout station includes marker deactivation unit 49 of the FIG. 6 system. A marker to be deactivated is introduced along path 50 into the deactivation unit and issued therefrom as deactivated marker 51, which now may pass freely through control zone 36 without acting upon the field therein in manner triggering alarm unit 47.

Figure 7:
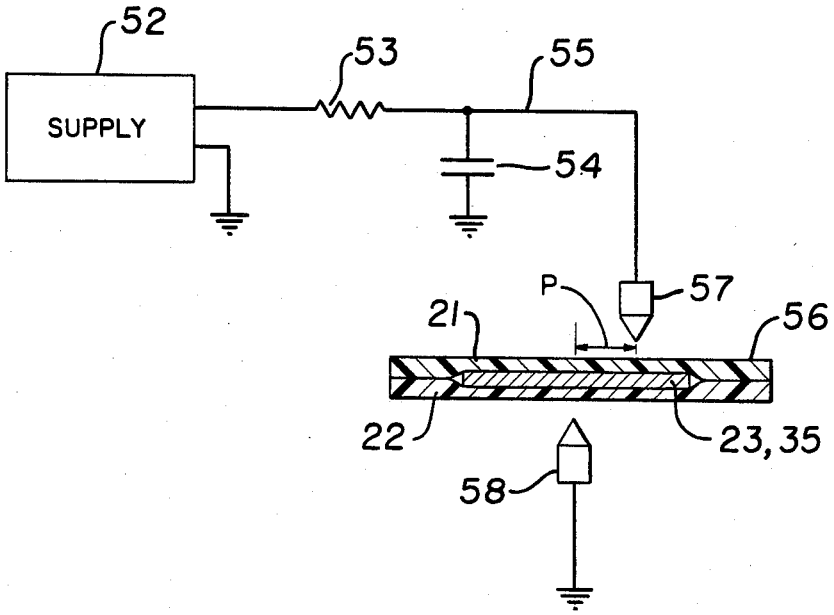
FIG. 7 is a schematic diagram of a first embodiment of the deactivating unit of the FIG. 6 system shown with a marker thereof.

A first embodiment of deactivation unit is shown in FIG. 7 as including an electrical power supply 52 having one output terminal grounded and a second output terminal connected through resistor 53 and capacitor 54 to ground. The supply, resistor and capacitor are selected to provide the desired output current pulse over line 55 when loaded by marker 56, shown in section and comprising the above-mentioned layers 21 and 22 and either wire 23 or ribbon 35. Insulation-piercing contacts 57 and 58 are provided, the former being connected to line 55 and the latter grounded. The capacitor will thus discharge into portion P of marker 56, elevating same to a temperature above the stress-relief temperature of the material comprising the marker active component.

Figure 8:
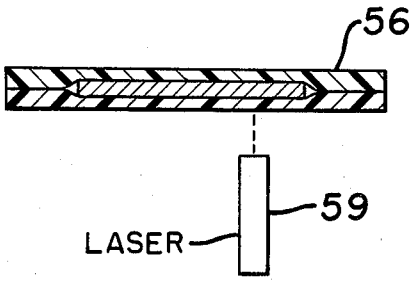
FIG. 8 is a schematic diagram of a second embodiment of the deactivation unit of the FIG. 6 system again shown with a marker thereof.

A variation from the FIG. 7 deactivation unit is shown in FIG. 8. Her, the invention looks to preconditioning the marker for localized crystallization. Laser 59 has its output directed onto the portion of the marker 56 intended to be crystallized. The resultant local heating of the marker portion gives rise to an increase in the electrical resistivity of the portion. Upon application of electrical current thereafter to the marker active component, as long as contacts 57 and 58 straddle the preconditioned portion, the current induced heating will be localized at the portion of higher resistance and hence crystallization will be confined to a narrow range along the component. Where desired, full crystallization may be effected through the use of radiant energy, without subsequent application of current.

Figure 9:
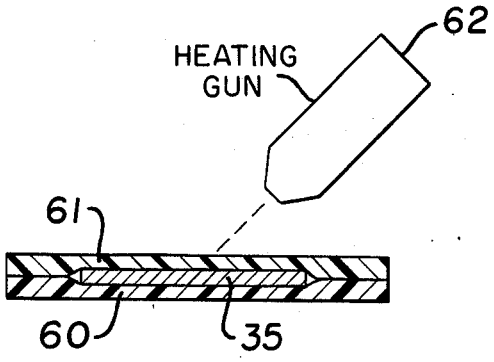
FIG. 9 illustrates a third embodiment of the deactivation unit of the FIG. 6 system for use with markers having stress induced magnetic discontinuities.

The deactivator embodiment of FIG. 9 is particularly useful for markers of type having locked-in stress. Here, the marker active component 35 is confined within heat-shrinkable laminates 60 and 61. Upon application of heat to the laminates from heating gun 62, the laminates shrink from their illustrated dimensions, thereby relaxing their constraint upon component 35 and permitting the component to relax and to have its locked-in stress released. The resulting marker has vastly different magnetic response characteristics since its stress-induced magnetic discontinuity is no longer present. It will be understood that the release of locked-in stress may be achieved by other mechanical arrangements.

As noted above, in making markers of type having stress-induced magnetic discontinuity, an annealing step is employed at temperature level below the material crystallization temperature. Accordingly, the material retains its amorphous character to the point of deactivation, and the embodiments of FIGS. 7 and 8 also apply for deactivation of this type of marker.

While the practices above discussed for deactivation have involved a change in the molecular organization of the marker active component, with the separation of the component into subcomponents of a body which remains unitary throughout the deactivation, the invention contemplates that one can actually cause physical separation of the component into separate bodies by use of the capacitor discharge of the FIG. 8 showing. the invention thus may be practiced by effecting molecular organization change in the course of deactivation involving additional effects, such as subsequent unitary body disruption. It is to be appreciated, however, that such dispuption is not required for deactivation, but may occur following modification of molecular organization, e.g., where the flash deactivation current pulse is of level sufficiently high to disrupt the unitary body after causing such change in molecular organization. Further, the invention contemplates deactivation of surveillance tag markers by modification of molecular organization as between surveillance use state and deactivation state irrespective of the magnetic character exhibited by the marker during surveillance use, e.g., markers subject to deactivation by molecular reorganization and not exhibiting large Barkhausen descontinuities.

Various changes in structure and modifications in method may be introduced in the foregoing without departing from the invention. Accordingly, it is to be appreciated that the particularly depicted and described preferred embodiment and practices are intended in an illustrative and not in a limiting sense. The true spirit and scope of the invention is set forth in the following claims.

I claim:

1. A method for deactivating an article surveillance marker having a component responsive, in the absence of deactivation, to incident magnetic energy for causing an associated article surveillance system to render an output alarm, said method including the deactivation step of modifying the molecular organization of at least a portion of said component.

2. A method for deactivating an article surveillance marker having a component responsive, in the absence of deactivation, to incident magnetic energy for causing an associated article surveillance system to render an output alarm, said method including the step of selecting said component to be of amorphous material, and a deactivation step rendering crystalline at least a portion of said amorphous material.

3. The invention claimed in claim 2 wherein said amorphous matter is selected to exhibit large Barkhausen discontinuities prior to such deactivation.

4. The invention claimed in claim 2 wherein such deactivation step is practiced by maintaining such portion of said component at a temperature above the crystallization temperature of said component, thereby to provide a coercive force in said portion different from the coercive force in the remainder of said component.

5. The invention claimed in claim 4 wherein said deactivation step is practiced by conducting electric current through said component.

6. The invention claimed in claim 4 wherein said deactivation step is practiced by conducting electric current selectively through said component portion.

7. The invention claimed in claim 4 wherein said deactivation step is practiced by applying radiant energy to said component.

8. The invention claimed in claim 4 wherein said deactivation step is practiced in part by applying radiant energy to said component and in part by conducting electric current through said component.

9. The invention claimed in claim 8 wherein such radiant energy applying step is practiced to pre-crystallize such portion of said component.

10. An electronic surveillance system marker comprising a component responsive to incident magnetic energy for causing an associated article surveillance system to render an output alarm and deactivatable by modification of the molecular organization of at least a portion of said component.

11. An electronic surveillance system deactivatable marker comprising a component responsive to incident magnetic energy for causing an associated article surveillance system to render an output alarm wherein said component is of amorphous matter adapted to be rendered crystalline in at least a portion thereof on such deactivation.

12. The invention claimed in claim 11 wherein said amorphous matter is selected to be a metal composition.

13. An electronic article surveillance system operative with an article marker of type comprising an unitary component responsive to incident magnetic energy for causing an associated article surveillance system to render an output alarm and deactivatable by modification of the molecular organization of at least a portion of said component, said system comprising:

(a) transmitting means for establishing an alternating magnetic field in a control zone of interest;

(b) receiving means for detection in said control zone of the presence of such marker if same is not deactivated; and (c) means for modifying the molecular organization of said marker component, thereby deactivating said marker.

14. The invention claimed in claim 13 wherein such means (c) includes means for modifying the molecular organization of a portion of said marker component.

15. An electronic article surveillance system operative with an article marker of type comprising an unitary deactivatable component responsive to incident magnetic energy for causing an associated article surveillance system to render an output alarm and deactivatable by modification of the molecular organization of at least a portion of said component, said system comprising:

(a) transmitting means for establishing an alternating magnetic field in a control zone of interest;

(b) receiving means for detection in said control zone of the presence of such marker if same is not deactivated; and (c) means for deactivating said component comprising an electric current supply for selective electrical connection to at least a portion of said marker component to thereby deactivate said marker.

16. The invention claimed in claim 15 wherein said current supply is operable at such current level as to maintain such portion of said marker component at a temperature above the crystallization temperature of said component and thereby to crystallize a coercive force in said portion different from the coercive force in the remainder of said component.

17. An electronic article surveillance system operative with an article marker of type comprising an unitary deactivatable component responsive to incident magnetic energy for causing an associated article surveillance system to render an output alarm, said system comprising:

(a) transmitting means for establishing an alternating magnetic field in a control zone of interest;

(b) receiving means for detection in said control zone of the presence of such marker if same is not deactivated; and (c) means for deactivating said marker component by applying radiant energy to said marker component.

18. The invention claimed in claim 17 wherein said radiant energy applying means comprises a laser.

19. The invention claimed in claim 17 wherein said radiant energy applying means comprises a source of heat.

20. An electronic surveillance system deactivatable marker comprising a component responsive to incident magnetic energy for causing an associated article surveillance system to render an output alarm wherein said component has retained mechanical stress and is adapted to be relieved of said retained mechanical stress on such deactivation.

21. An electronic article surveillance system operative with an article marker of type comprising a deactivatable component having amorphous material therein responsive to incident magnetic energy for causing an associated article surveillance system to render an output alarm, said system comprising:

(a) transmitting means for establishing an alternating magnetic field in a control zone of interest;

(b) receiving means for detection in said control zone of the presence of such marker if same is not deactivated; and (c) means for crystallizing at least a portion of said amorphous material to alter such response of said component, thereby deactivating said marker.

* * * * *

UNITED STATES PATENT AND TRADEMARK OFFICE

CERTIFICATE OF CORRECTION

PATENT NO. : 4,686,516

DATED : August 11, 1987

INVENTOR(S) : Floyd B. Humphrey

It is certified that error appears in the above-identified patent and that said Letters Patent is hereby corrected as shown below:

Column 2, line 48. Change "makrer" to --marker--

Column 3, line 43. Change "involvles" to -- involves --

Column 6, line 52. After "rather", insert -- than --

Column 7, line 62. Change "40. the" to -- 40. The --

Column 8, line 28. Change "Her," to -- Here, --

Column 9, line 2. Change "showing. the" to -- showing. The --

Column 11, Claim 20. Cancel.

Column 12, Claim 21. Renumber as -- 20. --

ON THE TITLE PAGE, "21 Claims" should read -- 20 Claims --.

Signed and Sealed this

Twenty-second Day of December, 1987

*Attest:*

*Attesting Officer*

DONALD J. QUIGG

*Commissioner of Patents and Trademarks*